US007401784B2

(12) United States Patent
Lean et al.

(10) Patent No.: US 7,401,784 B2
(45) Date of Patent: Jul. 22, 2008

(54) EASY 9™ CARD GAME

(76) Inventors: Prasoeur Lean, PO Box 6729, San Pablo, CA (US) 94806; Deviant Ung, 1003 Oak Grove Rd., Concord, CA (US) 94518

( * ) Notice: Subject to any disclaimer, the term of this patent is extended or adjusted under 35 U.S.C. 154(b) by 279 days.

(21) Appl. No.: 10/940,110

(22) Filed: Sep. 14, 2004

(65) Prior Publication Data

US 2006/0055112 A1 Mar. 16, 2006

(51) Int. Cl.
*A63F 1/00* (2006.01)

(52) U.S. Cl. ..... 273/292; 273/274

(58) Field of Classification Search ..... 273/292, 273/274, 309; 463/13, 12
See application file for complete search history.

(56) References Cited

U.S. PATENT DOCUMENTS 5,560,613 A * 10/1996 Nguyen ..... 273/292
6,638,161 B2 * 10/2003 Soltys et al. ..... 463/12
6,779,795 B1 * 8/2004 Le ..... 273/292
2003/0094761 A1 * 5/2003 Furuta et al. ..... 273/292

* cited by examiner

*Primary Examiner*—Benjamin H Layno
(74) *Attorney, Agent, or Firm*—West and Associates, AP; Stuart S. West; Charlotte Rodeen-Dickent

(57) ABSTRACT

Players place bets. A 36 card deck with the tens, Jacks, Queens, and Kings removed from a standard 52 card deck is dealt into eight piles of four cards each in front of a house dealer. A player/dealer chooses an action pile from the eight. A roll of three dice establishes who receives the action pile. The last four cards and any cards at vacant player positions are discarded. Players each create a front hand of two cards and a back hand of two cards of higher value than the pair of cards in the front hand. The player/dealer turns over his/her cards to the face side for both front and back hands. Each player in turn, beginning with the action hand, compares front and back hands with those of the player/dealer. Betting chips are paid or taken by the dealer/player depending on the comparative value of the player hands to the dealer hands.

3 Claims, 2 Drawing Sheets

Hand Ranking

| # | Pair(s) | # | Points |
|---|---|---|---|
| 1 | **A-A** | 10 | **9** |
| 2 | **9-9** | 11 | **8** |
| 3 | **8-8** | 12 | **7** |
| 4 | **7-7** | 13 | **6** |
| 5 | **6-6** | 14 | **5** |
| 6 | **5-5** | 15 | **4** |
| 7 | **4-4** | 16 | **3** |
| 8 | **3-3** | 17 | **2** |
| 9 | **2-2** | 18 | **1** |
| | | 19 | **0** (zero) |
| *Banker wins all copies and zero point. Tie breaking determined by single ranking card.* | | | |

FIG. 2

Breaking Tie

| |
|---|
| **9** |
| **8** |
| **7** |
| **6** |
| **5** |
| **4** |
| **3** |
| **2** |
| **Ace** |

FIG. 3

EASY 9™ CARD GAME

BACKGROUND OF THE INVENTION

1. Field of the Invention

The present invention relates to wagering card games and particularly to a fast-paced card game in which the number of cards in a standard deck are reduced by removing the tens, Jacks, Queens and Kings, the remaining cards being distributed in eight stacks of four cards, the players arrange their cards so they have a two-card back hand that ranks higher than their two-card front hand, which are then played against the dealer's hand.

2. Description of the Prior Art

Casino games include many subsets of games. In one subset, players wager on which of two or more hands will win. For example, Baccarat is a live table game that uses a standard deck of fifty-two playing cards. The object of Baccarat is for a player to successfully wager on which of two hands, designated the bank hand and the player hand, is going to win. The player is paid even money for the wager if he or she wagers on the winning hand and loses the wager if he or she selects the losing hand. The players, who embrace Baccarat, like the simplicity, rapid wager-resolution and low house advantage of the game, and especially its simple point-count rankings wherein hands are ranked in descending order as follows: 9, 8, 7, 6, 5, 4, 3, 2, 1, and 0 point. But the game is played with stacks of seven cards so that the play and scoring is somewhat time consuming.

Most of the prior art gaming card games use at least a full deck of cards and have unnecessarily complex scoring schemes taking more time to play.

Pai Gow Poker (also known as Asian poker) is a casino game in which each player plays against the bank and each receives seven cards after placing their bets against the bank. Then each player picks up his cards and sets them in two hands consisting of a two card set (one set having five cards, the other set having two cards) according to the rules of Draw Poker. Both hands must be winners against the casino in order to win the game against the casino. If one hand wins and the other hand loses it will be a push and the bet will stay for the next round of play.

U.S. Patent Application #20040009801, published Jan. 15, 2004 by Nama, describes an Indian poker casino game. The method of playing the card game is operated among multiple players, a dealer and a banker. The game is played with 15 decks of cards from J to A and 1 Joker from each deck, hence there are 255 cards altogether. All cards from 2 to 10 are removed. Alternately, the game is played with 2 decks of cards from J to A, hence there are 32 cards plus 3 Jokers total 35 cards altogether. All cards from 2 to 10 are removed. Each player places a wager before the banker shakes the dice cup, which contains 3 dices to determine where the action starts. The dealer will deliver 3 cards unexposed to each player. The players set their hands by making a one-card hand and a two-card hand. The two-card hand must rank higher than one card hand. After all players have set their hands, the dealer will then reveal the banker's cards the way the banker wants them to be set. Then the dealer will compare the cards of each player to the banker's cards and winners or losers or pushers are determined based on the comparison.

U.S. Pat. No. 5,540,444, issued Jul. 30, 1996 to Nguyen, indicates a method of playing a card game that is operated among a plurality of players and a house dealer. The method uses a deck of 32 cards. The 32-card deck is obtained from a conventional 52-card deck with an additional two jokers, all jack, queen, and king cards removed. Additionally, the six of hearts, six of spades, jack of hearts, jack of spades, ace of hearts, and ace of spades cards are removed. According to the method of the present invention, each player places a wager, and the house dealer deals four cards for each of the players. All of the sets of four cards are placed on the table, in a row, and the house dealer assigns the position of banker to one of the players. The banker then picks one of the eight hands, and roll a set of dice to determine which of the remaining players should receive that hand of four cards. The remaining hands are assigned to the remaining players in an orderly fashion. All of the players' cards are placed face down in an arranged order, except for the banker's hand, which is placed face up in an arranged order. Each player determines the arranged order of his hand. The players' cards are then sequentially compared to the banker's cards, and winners are determined based on the comparison.

U.S. Patent Application #20040007815, published Jan. 15, 2004 by Nama, discloses an Indian double super 9 casino game. The method of playing the card game is operated among multiple players, a dealer and a banker. The game is played with 12 decks of cards from A to 6, hence there are 288 cards altogether. All cards from 7 to K and Jokers are removed. According to the method of the present invention, each player places a wager before the banker shakes the dice cup, which contains 3 dices to determine where the action starts. The dealer will deliver 4 cards unexposed to each player. The players set their hands by making a front 2-card hand and a back 2-card hand. The back 2-card hand must rank higher than or at least, be even to the front 2-card hand. After all players have set their hands, the dealer will then reveal the banker's cards (front & back) the way the banker wants them to be set. Then the dealer will compare the cards of each player to the banker's cards and winners or losers or pushers are determined based on the comparison.

U.S. Patent Application #20040009801, published Jan. 15, 2004 by Nama, describes an Indian poker casino game. The method of playing the card game is operated among multiple players, a dealer and a banker. The game is played with 15 decks of cards from J to A and 1 Joker from each deck, hence there are 255 cards altogether. All cards from 2 to 10 are removed. Alternately, the game is played with 2 decks of cards from J to A, hence there are 32 cards plus 3 Jokers total 35 cards altogether. All cards from 2 to 10 are removed. Each player places a wager before the banker shakes the dice cup, which contains 3 dices to determine where the action starts. The dealer will deliver 3 cards unexposed to each player. The players set their hands by making a one-card hand and a two-card hand. The two-card hand must rank higher than one card hand. After all players have set their hands, the dealer will then reveal the banker's cards the way the banker wants them to be set. Then the dealer will compare the cards of each player to the banker's cards and winners or losers or pushers are determined based on the comparison.

U.S. Patent Application #20030234491, published Dec. 25, 2003 by Robinson, discloses a method of and apparatus for playing a casino card game with the object to get the numerical value of 9. The game is comprised of each player placing one wager and an optional Jackpot Side bet; the dealer dealing each player four face up cards and the dealer four face down cards; each player's four cards compared with the Jackpot Side bet combinations; each player selecting a two card front hand and a two card back hand and then the dealer turning over the dealer's four cards and selecting a two card front hand and back hand, and each player's front hand and back hand measured against the dealer's front hand and back hand. In the event of a tie, the dealer deals a tie-breaker card for the player and a tie breaker card for the dealer with the highest card winning, dealer winning ties.

U.S. Patent Application #20030114209, published Jun. 19, 2003 by Ritner, indicates a card game based on the well-known game of Pai Gow Poker, which is played with five cards which players arrange into a three-card hand and a two-card hand. The three-card hand includes slightly modified poker rankings. In order to win a primary wager, the player's three-card hand and two-card hand must beat the dealer's corresponding three-card hand and two-card hand. Additionally, players may place an independent secondary wager that is related to the poker ranking of the five cards received by the player or the relationship between the two-card hand and three-card hand. A pre-established pay table defines the secondary wager winning combinations and corresponding payouts. A bad beat jackpot is also an option. With only five cards to deal and arrange, the embodiments of the disclosed game are played faster than Pai Gow Poker thereby increasing the casino's revenue generating ability and player interest.

U.S. Patent Application #20030094761, published May 22, 2003 by Furuta, puts forth a card game that is played on a gaming table, with a regular standard deck of cards consisting of 52 cards, and with between one and seven players and a dealer. A hand is dealt for each player and the dealer. Each player is allowed an opportunity to place a bonus bet based on the hand. The hand is then formed into a high hand and a low hand, and a play bet is placed on these two hands. The player's high and low hands are compared to the dealer's high and low hands, respectively, and winners are paid according to a payout schedule. Each player's hand is compared to a bonus bet card configuration table. If a player's hand contains a bonus bet card configuration, the player is paid according to a bonus bet payout schedule.

U.S. Patent Application #20030073476, published Apr. 17, 2003 by Friedman, concerns a method of playing wagering games. According to a first embodiment the present invention, one or more players place a wager and a dealer deals four cards to the players and to the dealer. The players and dealer then inspect their four cards and arrange them into two separate two-card hands. After the arrangement is complete, five cards are dealt face-up as community cards to be used in conjunction with each of the players' and the dealer's two separate two-card hands. The players' wagers are then resolved by evaluating the players' two separate two-card hands and the dealer's two separate two-card hands in a predetermined fashion according to the conventional rules of poker. Various modifications to the first embodiment of the present invention are set forth herein.

U.S. Patent Application #20030034608, published Feb. 20, 2003 by Bui, illustrates a method of playing a mini-Baccarat type game. The game is played using a playing surface and playing cards. Three cards are randomly dealt to each of a plurality of players and the dealer. The method includes multiple wager options, including the step of placement of a bet that the cumulative value of the three cards of one or more of the plurality of players will exceed the cumulative value of the three cards of the dealer.

U.S. Patent Application #20030178774, published Sep. 25, 2003 by Marcilio, puts forth a card game to be played in casinos and wagering rooms. The card game played with a dealer and at least one player comprising the steps of providing the dealer with only one deck of cards having four suits containing cards numbered 2 through 10 and an ace, each player placing an initial bet, sequentially dealing four cards to each player and to the dealer from the only deck, each player reviewing his/her cards and choosing to continue to play placing a final bet, determining whether the dealer is eligible to play, revealing the dealer's cards if the dealer is eligible to play, and for each player continuing to play, determining whether the player has a higher hand than the dealer and paying money to the player if the player has a higher hand than the dealer, paying no money if the dealer and the player tie, and forfeiting the player's initial and final bets if the dealer has a higher hand than the player. Prior to the dealer revealing his/her cards, a player is chosen to select a super ace. The game also provides for the players receiving Add-on prizes and Insurance awards.

U.S. Pat. No. 4,659,087, issued Apr. 21, 1987 to Shen, provides a casino card game for a number of players which is played on a table that includes a station for the House and a number player stations adjacent thereto. Each station has positions for two pairs of cards and the player stations having a position for bet made by the player. The game is one in which each player is dealt four cards which the player has to make into two groups of two having a highest value, the value being achieved either by adding the face value of the cards, with the court card having a nominated face value of ten and disregarding the ten digit should there be one. Each player plays against the bank, the player having a winning hand, if both of his pairs are higher than both of the bank pairs, a losing hand, if both is his pairs are lower than both of the bank's pairs and a stand-off, if one pair is lower and one pair is higher than the bank's pairs.

U.S. Pat. No. 5,863,042, issued Jan. 26, 1999 to Lo, shows a card game that uses a standard fifty-two card poker deck. Each Player is dealt four or preferably five cards, and plays against a Banker. There is a primary wager and independent secondary wagers. In the primary wager, four-of-a-kind is an automatic winner for the Player. If the Player does not have four-of-a-kind, the Player splits the dealt cards into a high hand and a low hand. The low hand must not rank higher than the high hand, or it is a foul and the Player loses. The Player's low hand and the Banker's low hand are compared, and the Player's high hand and the Banker's high hand are compared. The Player wins if both hands win, loses if both lose, and ties in the event of a split. Hands are ranked three of a kind (for the five card version), pair, and point value. A higher ranked three-of-a-kind beats a lower ranked three-of-a-kind; a higher ranked pair beats a lower ranked pair; a higher point value beats a lower point value. Point value is calculated by adding the sum of the non-matched cards, and looking to the right-most digit. For example, 654 adds to 15 for a "point value" 5. Face cards count 10 or 0, and Aces count 11 or 1. The Banker wins ties in pairs. Ties in point value are broken as follows: in a low hand point value of 0 to 4, Banker wins tie. In other point value ties, the hand with the highest ranking card wins, the Banker winning highest card ties. Setting the dealt hand in the primary wager requires some skill. The Secondary Wager or Side Bet does not require skill; Players win their wagers based on the strength of the hands as dealt.

U.S. Pat. No. 5,788,241, issued Aug. 4, 1998 to Ung, claims a method of playing a joker dominoes and alternate playing methods. The invention comprises a two handed game in which comparison is made between the two hands of a player and a banker. Both hands of the player must have a point total greater than the corresponding two hands of the banker in order to win. Each hand of the player and the banker contain only two dominoes or cards.

U.S. Pat. No. 5,560,613, issued Oct. 1, 1996 to Nguyen, describes a method of playing California Paigow, which is operated among a plurality of players and a house dealer. The method uses a deck of 36 cards. The 36-card deck is obtained from a conventional 52-card deck with an additional two jokers, and all jack, queen, and king cards removed. Additionally, the three of hearts, three of spades, six of hearts, six of spades, nine of hearts, and nine of spades cards are removed. According to the method of the present invention, each player places a wager, and the house dealer deals four cards for each of the players. All of the sets of four cards are placed on the table in a row, and the house dealer assigns the position of banker to one of the players. The banker then picks one of the eight hands, and rolls a set of dice to determine which of the remaining players should receive that hand of four cards. The remaining hands are assigned to the remaining players in an orderly fashion. All of the player's cards are placed face down in an arranged order, except for the banker's hand, which is placed face up in an arranged order. Each player determines the arranged order of his hand. The player's cards are then sequentially compared to the banker's cards, and winners are determined based on the comparison.

U.S. Pat. No. 5,411,268, issued May 2, 1995 to Nelson, discloses a game that uses a standard 52 card deck, and is played by a minimum of an action player, a banker and a dealer. The dealer, deals the playing pieces, but does not act as the banker. The action player and banker place their wagers before the cards are dealt. The dealer deals 4 cards, each to the player and to the banker. The player, but not the banker, looks at his cards and arranges them in a front hand and a back hand and in any order desired. The front hand is to be played first. The banker's cards are turned over and placed in respective front and back hands. The two front hands are compared to show a win, lose or draw, using the rules of the game of Blackjack. If the action player wins, the banker satisfies the extent of the action player's wager, and that round of play terminates, and the remaining players lose their right to play in that round. Otherwise, play proceeds to the next player. If the action player loses, the amount of his wager is given to the banker. In case of a tie, the two back hands are compared to determine a winner and a loser, using the rules of the game of Poker. If there still exists a tie, the outcome is determined by pre-established rules.

What is needed is a fast-paced easy-to-play and easy-to-score gaming card game which allows many more games to be played in a given amount of time than prior gaming card games.

SUMMARY OF THE INVENTION

An object of the present invention is to provide a fast-paced easy-to-play and easy-to-score gaming card game which allows many more games to be played in a given amount of time than prior gaming card games.

A related object of the present game is to reduce the size of a standard 52 card deck to a 36 card deck by removing tens, Jacks, Queens, and Kings, and dealing four cards to each of at most eight players, who create a front hand and a back hand with two cards each, thereby creating an easy to learn and easy to score fast moving card game which allows many hands to be played in a short period of time.

Another object of the present invention is to distribute the stacks of dealt cards by rolling dice to eliminate cheating by people who might see the card values as they are dealt into eight piles of four cards each.

One more object of the present invention is to establish order of play by having the player/deal choose an action pile by placing an action button on the action pile and to roll three dice to determine the player position where the action pile is placed.

One further object of the present invention is to provide a game which may be scored quickly because each hand is only two cards and using only pairs and total point hand value for each hand.

In brief, a gaming card game playing method uses playing equipment comprising a playing surface with eight player positions with each having a marked space for a back hand with two cards, a front hand with two cards and a betting space for chips, one house dealer position with eight spaces for stacking eight piles of four cards each, a dice cup, three dice, and an action button. The gaming card game of the present invention is played with a standard 52-card deck with 1 D's, Jack's, Queen's, and King's removed for a maximum total of 36 cards. The game requires a player/dealer and all hands are compared to the player/dealer's hand.

Before the deal, each of the players posts a wager. The dealer stacks eight piles of four cards, one card at a time, and the remaining four cards are discarded. The player/dealer selects a pile of cards to be an action pile to start the distribution. The player/dealer then shakes three dice in a dice cup and counts around the positions at the table counter-clockwise. Counting from the player/dealer position, the sum of the dice determines who receives the first hand and where the action begins. The remaining hands go to the other players in counter-clockwise rotation. If the player position is vacant, the hand is discarded.

All players look at their cards and form two hands, a two-card front hand and a two-card backhand. The object of the game is to look for and form the hands with pairs or high number counts by adding the face value of the two cards. After all players have placed their two hands face down, the player/dealer's four cards are set and turned face up.

Beginning with the action button pile of cards, all the players' cards are exposed and compared to the player/dealer's hand and bets paid according to highest hand.

An object of the present invention is to provide a fast-paced easy-to-play and easy-to-score gaming card game which allows many more games to be played in a given amount of time than prior gaming card games.

A related advantage of the present game is that it is an easy to learn and easy to score fast moving card game which allows many hands to be played in a short period of time.

Another advantage of the present invention is that it eliminates cheating by people who might see the card values as they are dealt.

One more advantage of the present invention is that order of play is determined by chance.

One further advantage of the present invention is that it provides a game which may be scored quickly.

BRIEF DESCRIPTION OF THE DRAWINGS

These and other details of my invention will be described in connection with the accompanying drawings, which are furnished only by way of illustration and not in limitation of the invention, and in which drawings:

FIG. 2 is a table listing the values of different hands in descending order from the highest to the lowest;

FIG. 3 is a table listing the values of tie breaking cards in descending order from the highest to the lowest.

BEST MODE FOR CARRYING OUT THE INVENTION

Figure 1:
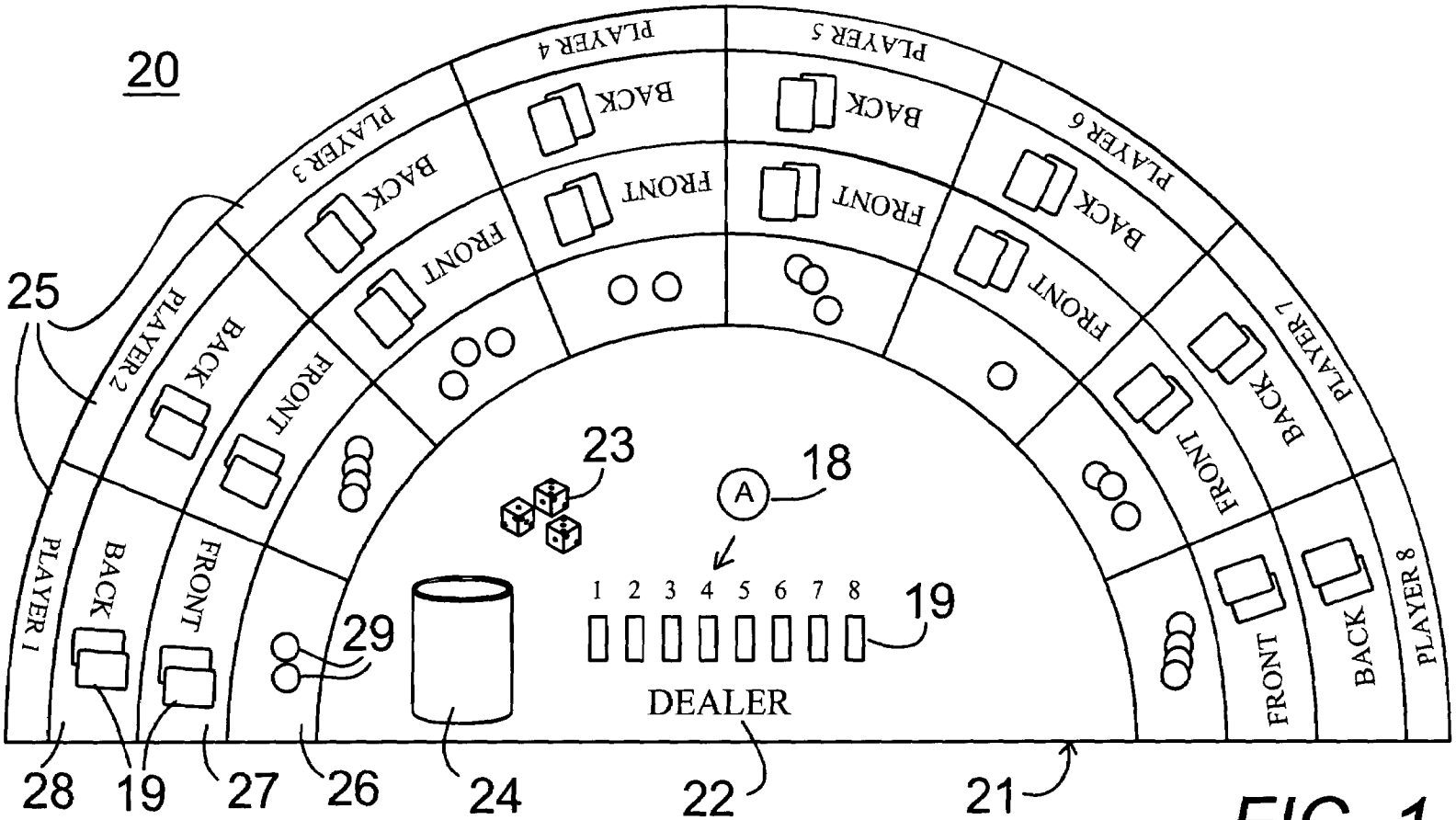
FIG. 1 is a plan view of a playing board, cards, dice and chips for the gaming card game of the present invention.

In FIG. 1, a gaming card game playing method uses playing equipment 20 comprising a playing surface 21 with eight player positions 25 labeled Player 1 to Player 8 with each having a marked space for a back hand 28 with two cards 19, a front hand 27 with two cards 19 and a betting space 26 for chips 29, one house dealer position 22 with eight spaces labeled 1-8 for stacking eight piles of four cards 19 each, a dice cup 24, three dice 23, and an action button 18.

The gaming card game playing method of the present invention comprises:

A first step of a house dealer removing Tens, Jacks, Queens, and Kings from a standard 52-card deck of playing cards and using the remaining deck of 36 cards to play a gaming card game.

A second step of determining one player to be a player/dealer.

A third step of each player posting a wager.

A fourth step of a house dealer stacking eight piles of four cards each, one card at a time, in front of the house dealer and discarding the remaining four cards.

A fifth step of the player/dealer selecting one of the eight piles to be an action pile to be used as an action hand to start the play by placing an action button 18 on the selected pile.

A sixth step of the house dealer shaking three dice in a dice cup and rolling the three dice and counting a sum total of the points shown on the three dice and using the sum to count around eight player positions at the table counter-clockwise starting at the dealer/player position to select a player to receive the action pile of cards as the player's action hand, placing the action hand in front of the player selected by the dice count, and placing the remaining piles of cards in the other seven player positions around the playing surface counter-clockwise from the action hand, the house dealer removing each pile from each player position where there is no player.

A seventh step each player, except the player/dealer, looking at his/her cards and forming two hands, a two-card front hand and a two-card back hand with the back hand having a higher score than the front hand.

An eighth step of the player/dealer turning both hands face up and each other player, beginning with the player having the action hand, turning over his/her hands, one-at-a-time and comparing his/her front hand to the player/dealer's front hand and his/her back hand to the player/dealer's back hand to determine which has a higher hand based on pairs being the best hand, using a scoring order illustrated in the table of FIG. 2, starting with a pair of Aces as the highest pair hand, and continuing with a pair of nines, eights, sevens, sixes, fives, fours, threes, and twos in descending order of value, and finally continuing with total point score by adding the values of non-paired cards with Aces counting one point and the other cards counting points of the added face values of the cards, using a ten point system from nine as the highest point hand down to zero as the lowest point hand based on a counting system wherein points totaling double digit numbers only count the second digit, so that ten equals zero points and eleven equals one point.

a ninth step of settling a bet for each player according to a system:

1. If the player wins both hands, the player/dealer pays out the amount wagered
2. If the player/dealer wins one hand and the player wins the other (push), no money is exchanged
3. If the player/dealer wins both hands, the player/dealer wins the player's wager
4. If the player and the player/dealer have the same hand(s), the player/dealer wins on all identical hand(s) and in an event of a tie, the ranking is settled based on individual card values, as shown in the table of FIG. 3, with nine being high and Ace being low.

One of the players may act as a bank for the game.

In the second step one player may volunteer to be a player/dealer.

It is understood that the preceding description is given merely by way of illustration and not in limitation of the invention and that various modifications may be made thereto without departing from the spirit of the invention as claimed.

What is claimed is:

1. A gaming card game playing method utilizing a playing surface comprising eight player positions and one house dealer position, the method comprising:

a first step of a house dealer removing Tens, Jacks, Queens, and Kings from a standard 52-card deck of playing cards, to provide a remaining deck consisting of only 36 cards, each remaining card in the deck has a positive number point value from 1 to 9 indicated by the face value of the card and the number of suit symbols on the card so that each card has a value to add to a score and so that the game is fast-paced and easy to learn and easy to score quickly to allow more games to be played in a given amount of time than prior gaming card games, and using the remaining deck consisting of only 36 cards to play a gaming card game;

a second step of determining one player to be a player/dealer;

a third step of each player posting a wager;

a fourth step of a house dealer stacking eight piles of four cards each, one card at a time, in front of the house dealer and discarding the remaining four cards;

a fifth step of the player/dealer selecting one of the eight piles to be an action pile to be used as an action hand to start the play by placing an action button on the selected pile;

a sixth step of the house dealer shaking three dice in a dice cup and rolling the three dice and counting a sum total of the points shown on the three dice and using the sum to count around eight player positions at the table counter-clockwise starting at the dealer/player position to select a player to receive the action pile of cards as the player's action hand, placing the action hand in front of the player selected by the dice count, and placing the remaining piles of cards in the other seven player positions around the playing surface counter-clockwise from the action hand, the house dealer removing each pile from each player position where there is no player;

a seventh step each player, except the player/dealer, looking at his/her cards and forming two hands, a two-card front hand and a two-card back hand with the back hand having a higher score than the front hand;

an eighth step of the player/dealer turning both hands face up and each other player, beginning with the player having the action hand, turning over his/her hands, one-at-a-time and comparing his/her front hand to the player/dealer's front hand and his/her back hand to the player/dealer's back hand to determine which has a higher hand based on pairs being the best hand starting with a pair of Aces as the highest pair hand, and continuing with a pair of nines, eights, sevens, sixes, fives, fours, threes, and twos in descending order of value, and finally continuing with total point score by adding the values of non-paired cards with Aces counting one point, indicated by the single suit symbol on the card, and the other cards counting points of the added face values of the cards, indicated by the face number and number of suit symbols on each card for a uniform scoring system, using a ten point system from nine as the highest point hand down to zero as the lowest point hand based on a counting system wherein points totaling double digit numbers only count the second digit, so that adding two cards together totaling ten equals zero points and totaling eleven equals one point;

a ninth step of settling a bet for each player according to a system:

1. If the player wins both hands, the player/dealer pays out the amount wagered
2. If the player/dealer wins one hand and the player wins the other (push), no money is exchanged
3. If the player/dealer wins both hands, the player/dealer wins the player's wager
4. If the player and the player/dealer have the same hand(s), the player/dealer wins on all identical hand(s) and in an event of a tie, the ranking is settled based on individual card values with nine being high and Ace being low.

2. The method of claim 1 wherein one of the players acts as a bank for the game.

3. The method of claim 1 wherein the second step comprises one player volunteering to be a player/dealer.

* * * * *